US010435202B2

(12) United States Patent
Smith

(10) Patent No.: US 10,435,202 B2
(45) Date of Patent: Oct. 8, 2019

(54) CAP WITH SPOUT FOR FLUID TRANSFER FROM CONTAINERS

(71) Applicant: Martasz Smith, Oak Park, IL (US)

(72) Inventor: Martasz Smith, Oak Park, IL (US)

( * ) Notice: Subject to any disclaimer, the term of this patent is extended or adjusted under 35 U.S.C. 154(b) by 0 days.

(21) Appl. No.: 15/895,702

(22) Filed: Feb. 13, 2018

(65) Prior Publication Data

US 2018/0229894 A1 Aug. 16, 2018

Related U.S. Application Data

(60) Provisional application No. 62/459,043, filed on Feb. 14, 2017.

(51) Int. Cl.

| | |
|---|---|
| ***B65D 25/44*** | (2006.01) |
| ***B65D 47/12*** | (2006.01) |
| ***B65D 5/74*** | (2006.01) |
| ***B65D 47/06*** | (2006.01) |
| ***B65D 47/08*** | (2006.01) |

(52) U.S. Cl.

CPC ..... *B65D 25/44* (2013.01); *B65D 5/74* (2013.01); *B65D 47/063* (2013.01); *B65D 47/0838* (2013.01); *B65D 47/127* (2013.01)

(58) Field of Classification Search

CPC ..... B65D 5/74; B65D 25/44; B65D 47/063

USPC ..... 222/91, 488, 523, 525, 539, 541.6, 222/566–570

See application file for complete search history.

(56) References Cited

U.S. PATENT DOCUMENTS

| | | | | |
|---|---|---|---|---|
| 2,049,900 | A | 8/1936 | Evans et al. | |
| 4,073,413 | A * | 2/1978 | Tabler | B65D 47/063 222/529 |
| 4,560,081 | A * | 12/1985 | Adams | B65D 47/063 220/260 |
| 5,005,732 | A | 4/1991 | Penn | |
| 5,088,632 | A * | 2/1992 | Odet | B65D 47/063 222/529 |
| 6,935,389 | B1 | 8/2005 | Rinaldi | |
| 7,264,027 | B2 | 9/2007 | Rosenbaum | |
| 7,328,820 | B2 * | 2/2008 | Young | B65D 47/0838 215/235 |
| 8,453,889 | B2 * | 6/2013 | Park | B65D 47/063 222/528 |
| 9,056,699 | B2 | 6/2015 | Crosby | |
| 9,533,796 | B2 * | 1/2017 | Selina | B65D 25/44 |
| 9,550,606 | B2 | 1/2017 | Crosby | |
| 2013/0074448 | A1 | 3/2013 | Dal Toso | |

(Continued)

FOREIGN PATENT DOCUMENTS

WO 03002422 A1 1/2003

OTHER PUBLICATIONS

International Patent Application No. PCT/US2018/018016, International Search Report and Written Opinion, dated Apr. 30, 2018.

*Primary Examiner* — Vishal Pancholi
(74) *Attorney, Agent, or Firm* — DLA Piper LLP (US)

(57) ABSTRACT

A cap device for a container is provided. The cap device comprises a cover, a base and an expandable/extendible collapsible spout attached to or integrated with the base. When the cover is in a closed position, the collapsible spout may be in a retracted position for easy storage. When the cover is open, the collapsible spout may be extended to assist with pouring a fluid from the container to another location.

12 Claims, 9 Drawing Sheets

(56) References Cited

U.S. PATENT DOCUMENTS

| | | | |
|---|---|---|---|
| 2014/0138408 | A1 | 5/2014 | Loya |
| 2017/0088317 | A1 | 3/2017 | Crosby |

* cited by examiner

CAP WITH SPOUT FOR FLUID TRANSFER FROM CONTAINERS

CROSS REFERENCE TO RELATED APPLICATIONS

The present disclosure claims priority to and the benefit of U.S. Provisional Application No. 62/459,043 filed on Feb. 14, 2017, which is incorporated by reference in its entirety.

TECHNICAL FIELD

The present disclosure relates to a cap device that has a spout design for pouring liquid. In some embodiments, the cap device may be useful for transferring fluid materials from a container to another object.

BACKGROUND

Spouts are used in many industries to efficiently, safely, and without spillage, transfer materials such as liquids, solids and even gases from one location to another. Many such spouts are cumbersome, expensive, messy, and are not disposable. Traditionally, a container holding a liquid material is first opened by removing the cap, and then poured to or into another location. In some circumstances, to avoid messy spills or difficult to reach spaces, the liquid may be poured through a spout to or into another location, for example the windshield wiper container in an automobile. This requires the use of separate spout, that must first be located, possibly cleaned to prevent contamination, and then placed or held before the fluid is transferred to another location. Fluids include but are not limited to windshield washer fluid, oil, brake fluid, transmission fluid, power steering fluid, detergent, water, antifreeze, and the like.

Accordingly, there is a need for an improved cap device that can be used to transfer liquid in a convenience and cost-effective manner that does not require the use of a separate spout.

SUMMARY

The present disclosure is directed towards a container cap with a spout design. Embodiments of the present disclosure may be useful for transferring fluid materials from a container to another location, such as an automobile component. The disclosed embodiments may include a spouted cap that may adapt to openings of different containers or be an integrated part of containers. In some embodiments the disclosed spouts may be transferrable between containers or permanently attached to a container.

In some embodiments, a cap device may include a cap cover, a cap base having an interior opening and being connected to the cap cover, and a collapsible spout integrated with the cap base. When the cap device is in a closed configuration, the cap cover may interact with the cap base to prevent fluid flow and form a cavity between the cap cover and the cap base. The collapsible spout may be in a collapsed form and received within the cavity. When the cap device is in an open configuration, the cap cover may interact with the cap base to allow fluid flow and the collapsible spout may be extended from the cap device and form a passage for transferring fluid.

In some embodiments, a fluid container may include an opening, and a cap device attached to the fluid container. The cap device may include a cap cover, a cap base having an interior opening and being connected to the cap cover. A collapsible spout may be integrated with the cap base. When the cap device is in a closed configuration, the cap cover may interact with the cap base to prevent fluid flow and form a cavity between the cap cover and the cap base. In the closed configuration the collapsible spout may be in collapsed form and received within the cavity. When the cap device is in an open configuration, the cap cover may interact with the cap base to allow fluid flow and the collapsible spout may be extended from the cap device and form a passage for transferring fluid.

In some embodiments, a method for dispensing fluid from a container, may include using a fluid container having a cap device including a collapsible spout, and dispensing fluid from the container when the collapsible spout is in extended form.

BRIEF DESCRIPTION OF THE DRAWINGS

The accompanying drawings, which are incorporated in and constitute a part of this specification, illustrate several embodiments and, together with the description, serve to explain the disclosed principles. In the drawings.

DETAILED DESCRIPTION

Figure 1:
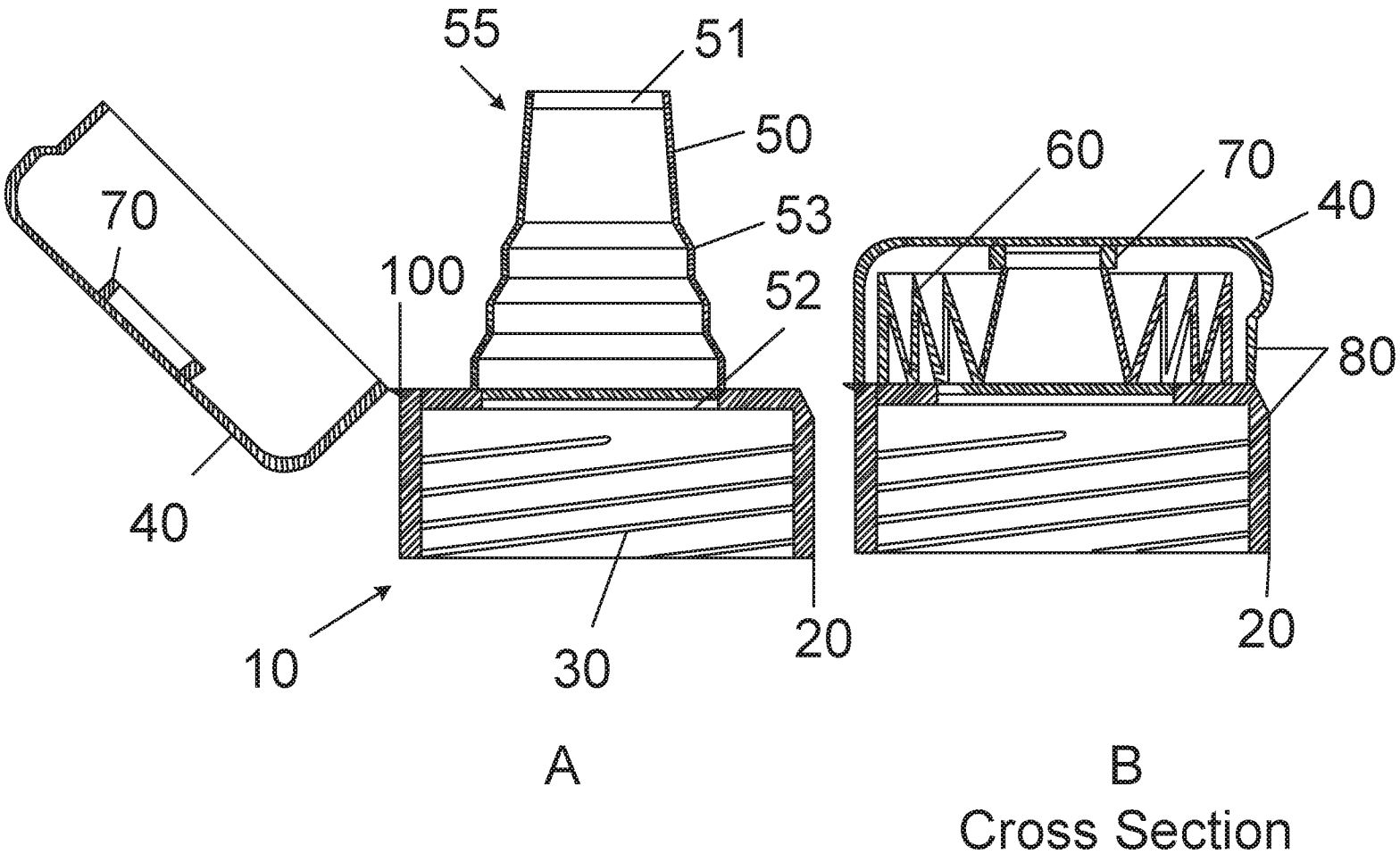
FIG. 1 shows open (A) and closed (B) views of a cross-section of an exemplary apparatus along with the detailed threading in the base and the spouts in collapsed form in the closed view.

Disclosed herein is cap device with a collapsible spout. In some embodiments, the spout is a spout. The cap device can be used to transfer liquid from a container. In some embodiments, the cap device functions as an independent apparatus that can be attached to a compatible container. In some embodiments, the cap device forms an integrated part of a container.

As used and described herein, the terms "cap device," "cap device with a spout," "cap with spout," "spouted cap," "spouted device," and "cap" can all be used interchangeably to mean the same thing.

As used and described herein, the terms "fluid" and "liquid" are used interchangeably. In some embodiments, fluid may include a dry powder, or any other material capable of flowing similar to a liquid.

In some embodiments, a spouted cap may include a top cover and a base. The cap base may include a hollow interior opening passing through the base configured to accommodate the spout. In some embodiments, the spout cap may have open and closed configurations. In the closed configuration, the top cover may touch or be joined or fixed to the base of the spout cap so as to close off or seal the interior opening of the base. The spout cap may further include a spout that is attached to or integrated with the base. In some embodiments, the cap cover may close to cover the base such that a cavity is formed between the cap cover and the cap base. Integrated with or attached to the cap base may be a foldable or collapsible spout. While in expanded or extended form, the spout may guide liquid to a desired location to prevent undesired spillage. In collapsed form, the spout may be completely retained within the cavity that is formed between the cap cover and the cap base.

In one aspect, the spouted cap functions as a cap to retain liquid within a container. For example, it can be attached to an opening on a container to keep liquid material within the container until it is ready to be transferred, for example to be poured to or into another location. The cap base is connected to the cover at the top side; for example, via an attachment piece at the outer rim of the base. The bottom of the base can be connected to an opening of a container. For example, in some embodiments, the base is threaded interiorly for attachment to a container through an exteriorly threaded counterpart opening. In some embodiments, the base is threaded exteriorly for attachment to a container through an interiorly threaded counterpart opening. In some embodiments, threading on the cap base and the opening on the container are matched to create a seal to prevent liquid material within the container from leaking when the cap is closed.

In one aspect, attached to the top of the cap base is a collapsible spout. In some embodiments, the spout can be collapsed or folded to reduce its volume such that it can be contained within the cavity between the base and the top cover. In some embodiments, the collapsed or folded spout can be expanded. The cap is in the open configuration when the spout is expanded.

In another embodiment, the base contains an integrated, expandable or extendable spout that can be integrated generally anywhere in the base, but preferably near the top of the base for ease of use and storage. In another embodiment, the base has a cover that when closed is in contact with the top of the base and houses the spout in a non-expanded condition. When the cap is in this closed configuration it prevents the material in the container from spilling out. In another embodiment, the cap is in an open position when the cover is open, so that the spout may be expanded or otherwise extended into a transferring or pouring position to guide liquid transfer.

In another embodiment, the spout may be extended or expanded with the help of a tab attached to the spout, preferably to the bottom of the spout, so that a user can pull on the tab and thereby extend the spout into its full working position. In some embodiments, there may be a need to extend the spout only partially to accomplish a liquid transfer. Nonetheless, the container may be considered to be in an open position for purposes of the transfer.

In another embodiment, the spout is constructed in an accordion-style form that permits easy expansion and retraction (e.g., collapsing) by the user. The accordion-style form also provides for a spout device that when extended partially or fully is bendable in multiple directions for ease of use and transferring materials to or into difficult to reach locations. In some embodiments, the spouted device is disposable and 100% safe for recycling. In another embodiment the spout device may be sold separately from, or in combination with, the container.

One embodiment of the invention is depicted in FIGS. 1A and 1B. Referring to FIG. 1A, cap device 10 includes a cap base 20 and a cap cover 40. Cap base 20 and cap cover 40 are connected at attachment 100. For example, attachment 100 can be a living hinge. In other embodiments, attachment 100 can be a cover release, a Snap-On motif, a screw-on motif, or a plug-in motif.

Cap base 20 has a continuous side forming an interior opening. In some embodiments, the inside of cap base 20 includes threading 30 for attaching the cap to an opening of a container. The opening includes exterior threads that interact with threading 30 to create secure attachment between the cap device and the container. In some embodiments, the outside of cap base 20 includes threading 30 for attaching the cap to an opening of a container. In such embodiments, the opening includes interior threads that interact with threading 30 to create secure attachment between the spout device and the container. Other structural motif can be used to attach the cap device to an opening of a container. For example, the structure motif can be a Snap-On motif, a screw-on motif, or a plug-in motif.

In one embodiment, the top side of cap base 20 includes a spout 50. In one embodiment, spout 50 has a bottom portion 51 and top portion 52. As depicted in FIG. 1A, in some embodiments spout 50 has a series of stepped, concentrically formed rings 53 that allow the spout to be expanded and collapsed in an accordion-like manner. FIG. 1A illustrates spout 50 in extended form 55 and FIG. 1B shows the spout in collapsed form 60. In collapsed form, a cap with the collapsible spout design can be stored easily, either by itself or as part of a container. When partially or fully extended, the spout can be used to pour fluids. Fluids include but are not limited to windshield washer fluid, oil, brake fluid, transmission fluid, power steering fluid, detergent, water, antifreeze, and the like. In one embodiment, when the spout is extended, it may be manipulated by bending it in multiple directions to pour a fluid to a tight or restricted space. The accordion-like spout design allows easy manipulation and control of the spout in all conditions and directions.

In one embodiment, the spout has a tab (not depicted) at that bottom of the spout 51, or at another location(s) to assist a user in extending the spout and, if necessary, retracting the spout. For example, the spout may be extended or expanded with the help of a tab attached to the spout, preferably to the bottom of the spout, so that a user can pull on the tab and thereby extend the spout into its working position.

In certain embodiments where the spout is not extended, cap cover 40 includes a structure 70 that interacts with the bottom of spout device 51 to secure the bottom of the spout and provide seal-proof storage for liquid within a container (FIG. 1B). In this case, cap device 10 is considered to be in a "closed" condition when the spout is collapsed (see element 60), cap cover 40 is closed and structure 70 interacts with the bottom of spout 51. In another embodiment, structure 70 does not need to interact directly with the spout in order for the cap to be closed, provided that is prevents liquid from spilling or leaking from the container when closed. For example the seal between the cover and base when in a closed condition may be sufficient to prevent leakage or spillage. In another embodiment, the bottom of the cap cover may contain a soft liner material that interacts with bottom 51 of spout to form a tight seal that prevents leakage or spilling when the cap is closed.

In some embodiments, the cap device of the present disclosure has a cover 40 that is attached to the base 20 in its final integrated form. See FIG. 1 element 100. In practice, element 100 could be formed during manufacture of the cover and base, but could also result from other means such as a glue joint or other bonding procedure after cover 40 and base 20 are separately formed.

In other embodiments, the exemplified cover 40 and base 20 may come in different shapes and sizes, provided that internal threading 30 of the base allows for the attachment to the container of choice. As noted, in other embodiments, described herein the attached means between the base and container may differ.

Figure 2:
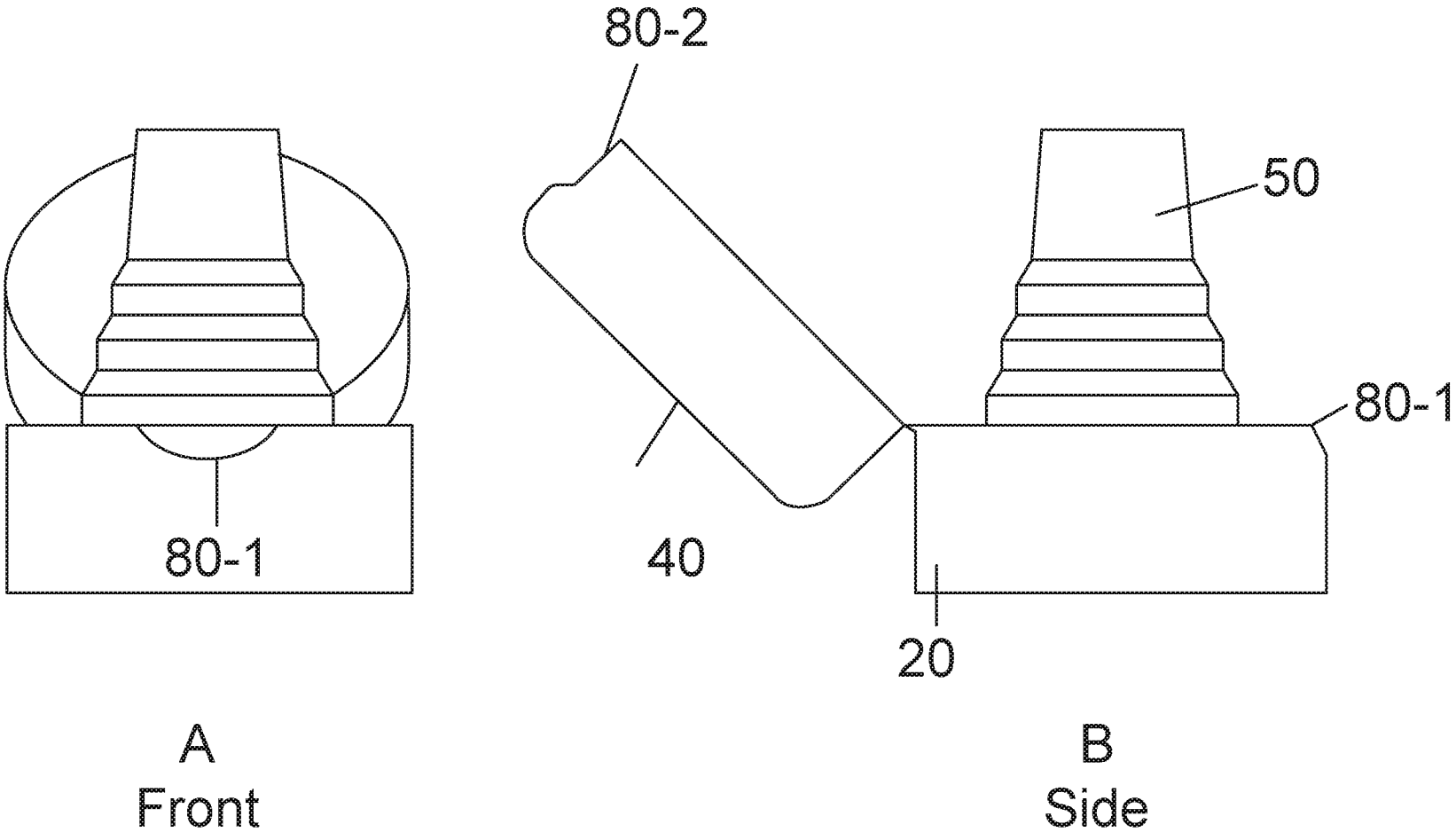
FIG. 2 shows views of an exemplary apparatus in an open configuration, including a view (A) showing a flip open mechanism in the base, the expanded spout, and the cover (behind), as a well as a side view of the apparatus (B).

In the closed configuration, cap base 20 and cap cover 40 form a secure connection with each other; for example, via a structure motif 80. FIGS. 2A and 2B provide an example, illustrating how parts of structure motif 80 interact with each other. FIG. 2A shows a front view of a cap device of FIGS. 1A and 1B and FIG. 2B shows a side perspective view of cap device 10, both in open configuration and with the integrated spout extended away from cap base 20.

A lip-like motif 80-1 can be seen, located on the top front side of cap based 20, which interacts with a corresponding structure 80-2 on the bottom side of cap cover 40 to form a secure connection. In one embodiment, the cover 40 and base 20 have indentations 80 adjacent each other, where the respective surfaces meet to form a release system structure to enable a user to open the cover 40 and allow extension of the spout 50. In some embodiments, cap base 20 and cap cover 40 are permanently connected with each other. In some embodiments, cap base 20 and cap cover 40 are separate parts and a screw-on motif can be used to attach the cap cover to the cap base. In another embodiment, the cap (cover and/or base) has an indented structural element on its outer surface to enable a user to easily lift or "flip open" the cover to get access to the expandable spout. Additional structure motifs for forming the secure connection include but are not limited to a click and lock motif, a Snap-On motif, or a plug-in motif.

Figure 3:
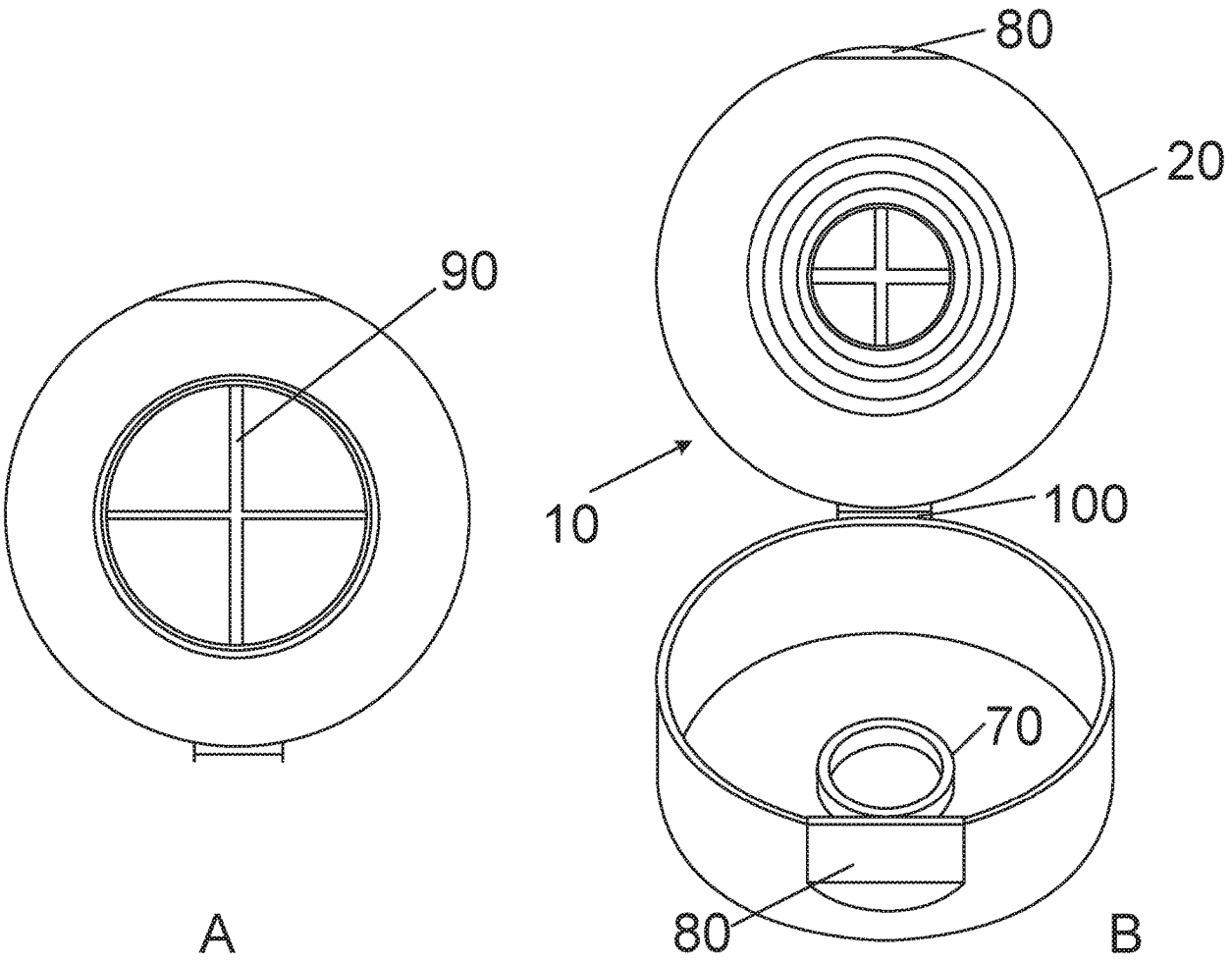
FIG. 3 shows aerial views of an exemplary apparatus in an open configuration, including views looking down at the cap into the spout (with partial obstruction via cross-hatching) without (A) or with the cover (B).
Figure 4:
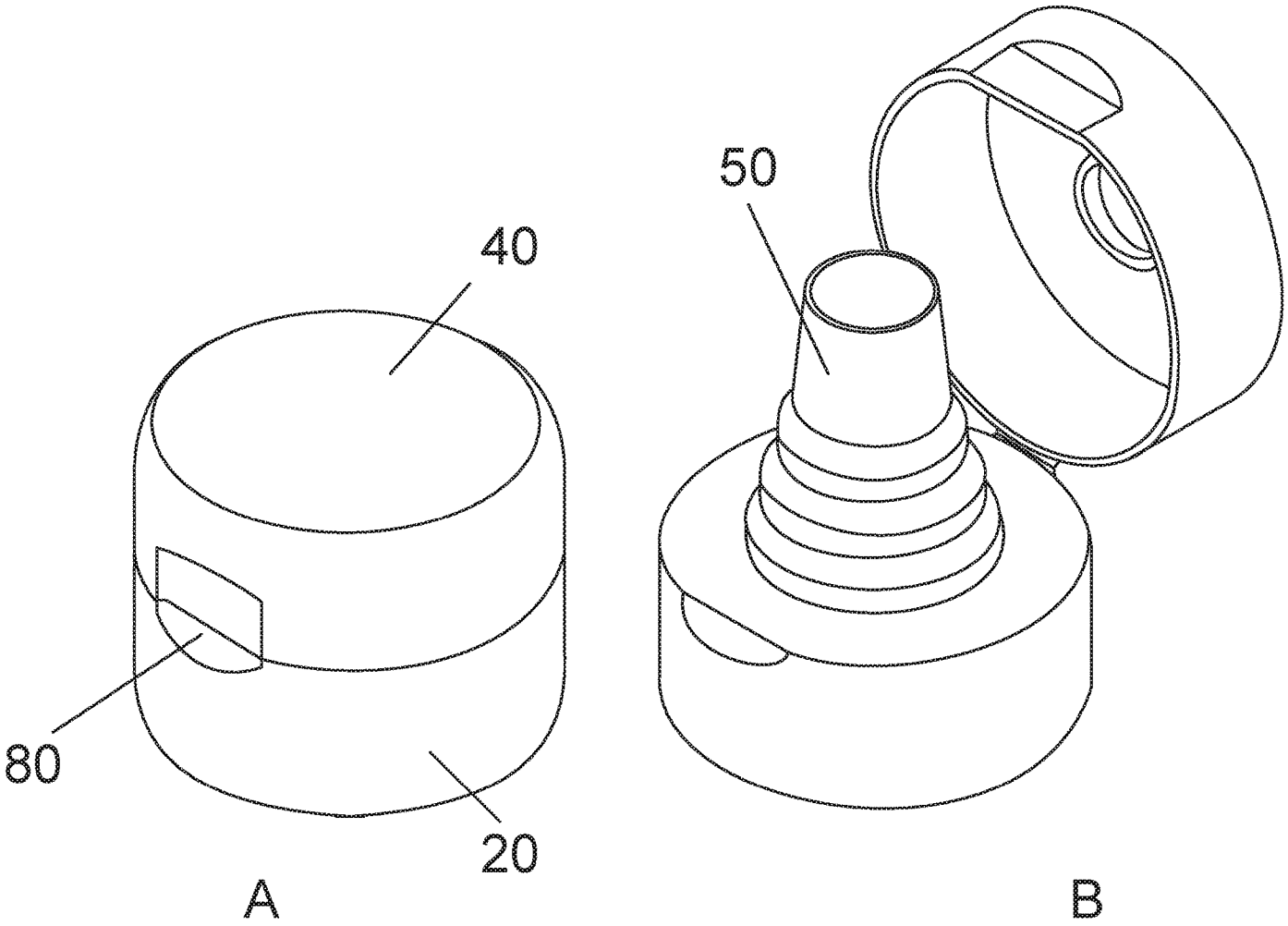
FIG. 4 shows an exemplary apparatus in closed (A) and open (B) configurations, where, in the open form, the spout is in an expanded form.

FIGS. 3A and 3B show top views of cap device 10 when it is in closed and open configurations. Referring to FIG. 3A, cap cover 40 is cut away to show a partial barrier 90 (e.g., a cross-hatch). The partial barrier can control liquid flow and prevents unwanted materials from flowing from a container through the spout 50, and can even prevent unwanted materials flowing into the container during initial filling. In some embodiments, partial barrier 90 has a cross-hatch form. In some embodiments, the partial barrier 90 may be configured to prevent the collapsible spout from extending into the container attached to the cap device. In some embodiments, this may prevent degradation of the spout by corrosive materials contained within the container or prevent contamination risk. In some embodiments, partial barrier 90 has a grid-like or mesh-like form. FIGS. 4A and 4B show cap device 10 in closed (4A) and open form (4B) in perspective side views.

Figure 5:
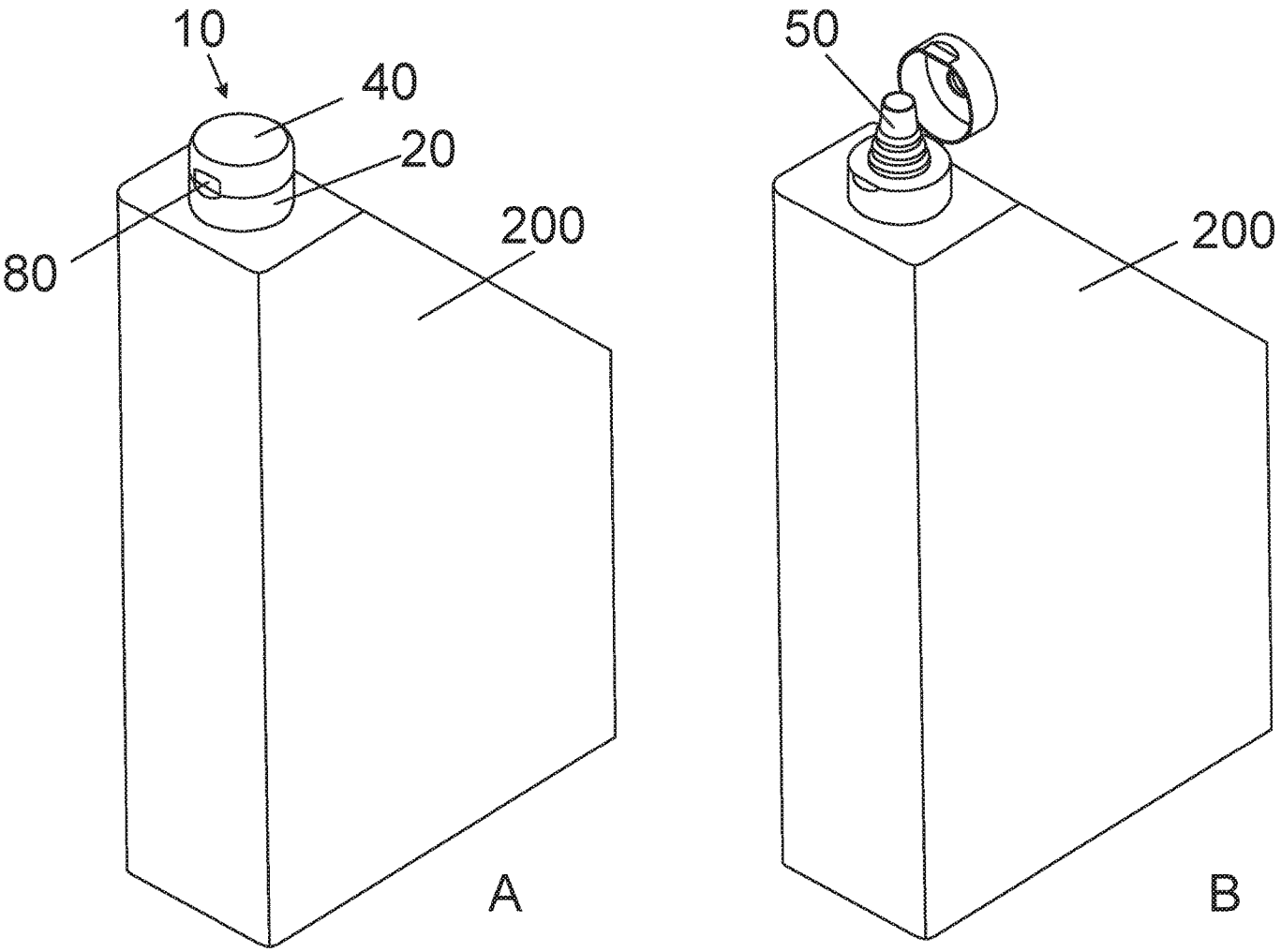
FIG. 5 shows a first embodiment of an oil can with closed (A) and flipped open (B) caps on top.
Figure 6:
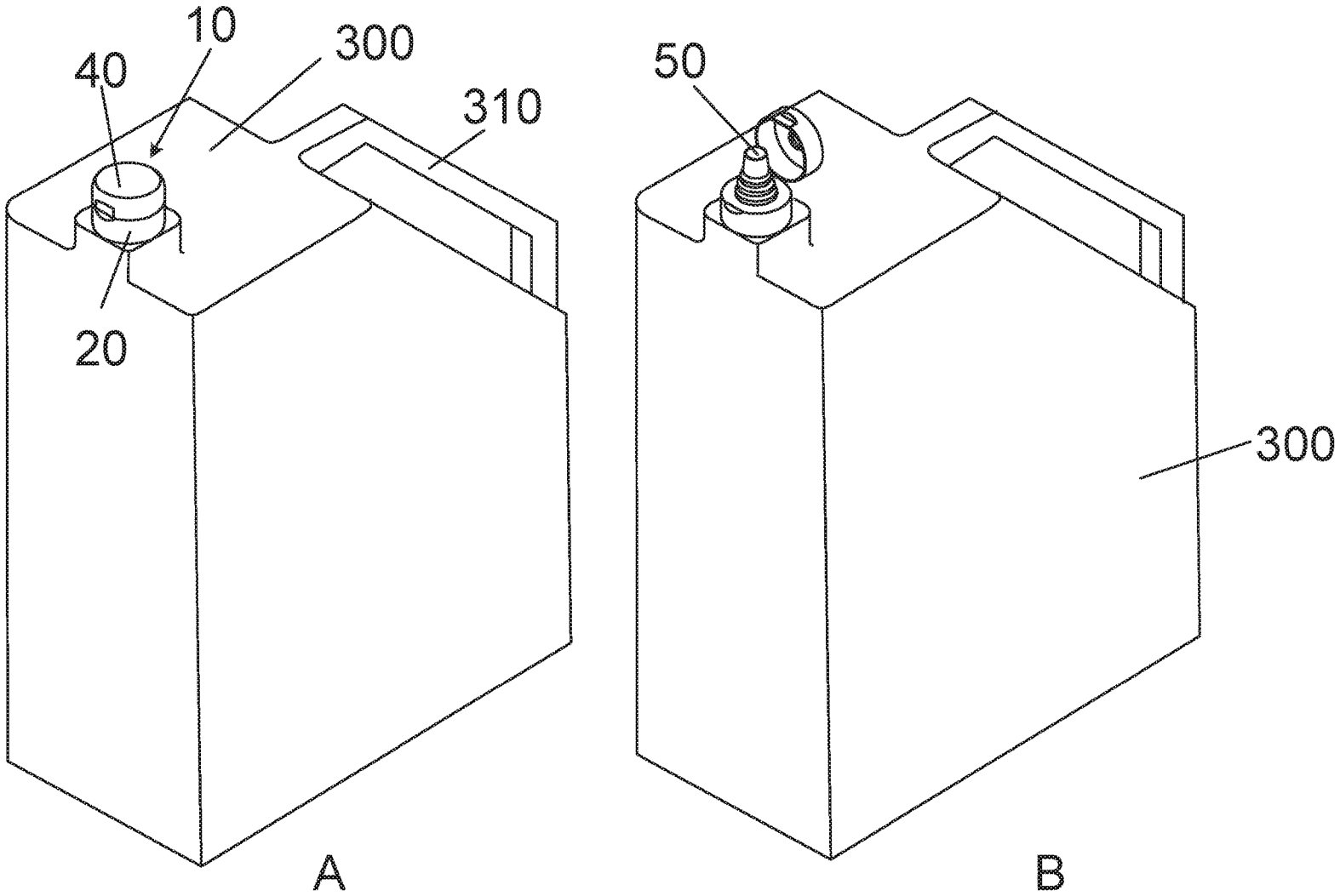
FIG. 6 shows a second embodiment of an oil can with closed (A) and flipped open (B) caps on top.
Figure 7:
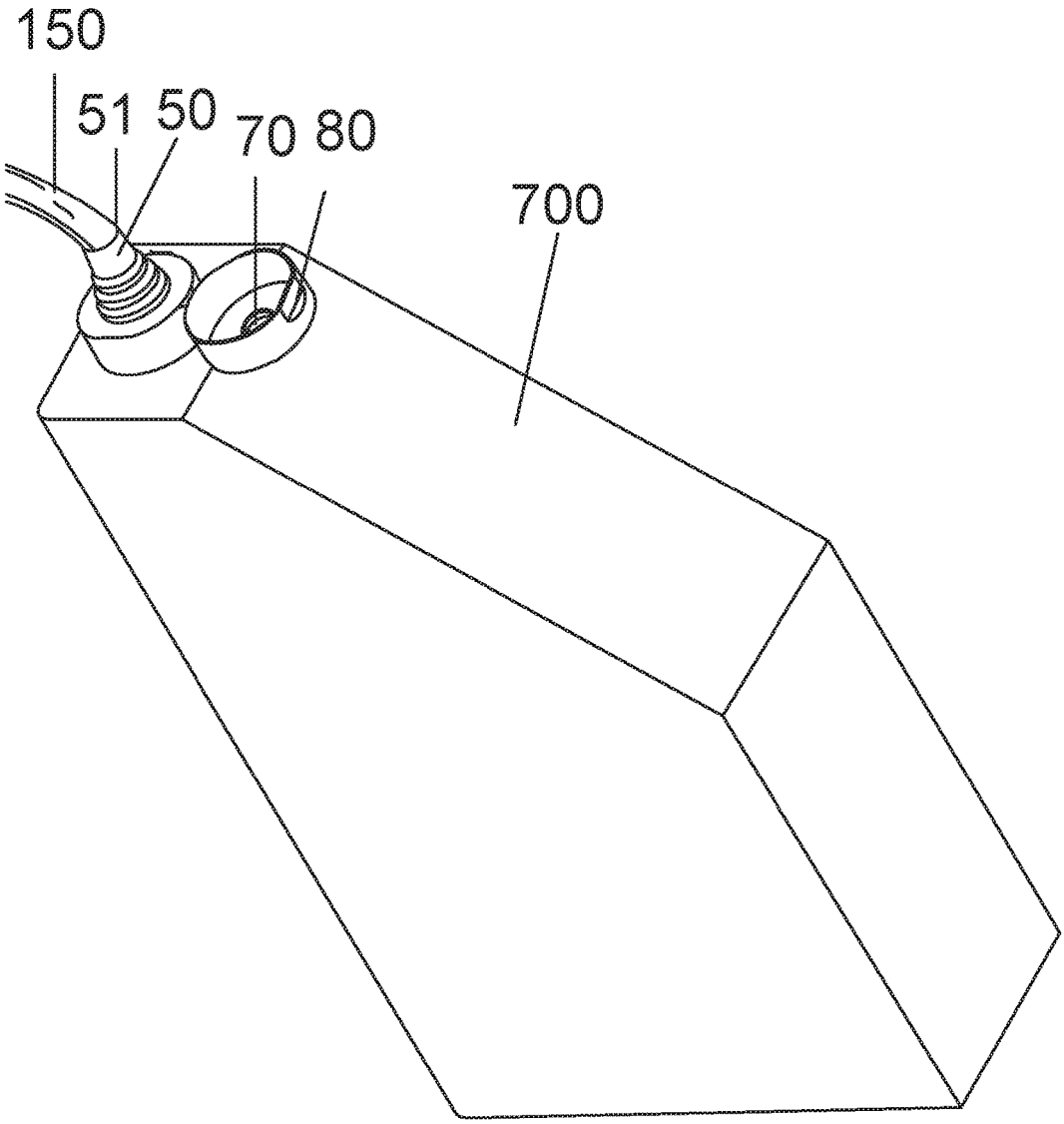
FIG. 7 shows an oil can with the attached cap of the invention which is flipped open allowing the oil to be dispensed from the can.

FIGS. 5 and 6 show two styles of containers 200, 300 (without and with handle 310, respectively) with the cap device as described herein, in the open (5B and 6B) and closed (5A and 6A) positions. FIG. 7 shows a container 200 containing cap device 10 in an open position and pouring a liquid material 150 from the bottom of spout 51. One of skill in the art would understand that a container can have any shape or size so long as it includes a compatible motif for securing a cap device to an opening of the container. As an independent device, cap device 10 can be transferred from one container to another container so long as both containers can secure the cap device to an opening on the containers.

In some embodiments, cap device 10 is an integrated part of a container. For example, instead of being attached to a container via a removable mechanism (e.g., a screw-on mechanism), cap device 10 can be permanently fused or attached to a container.

Figure 9:
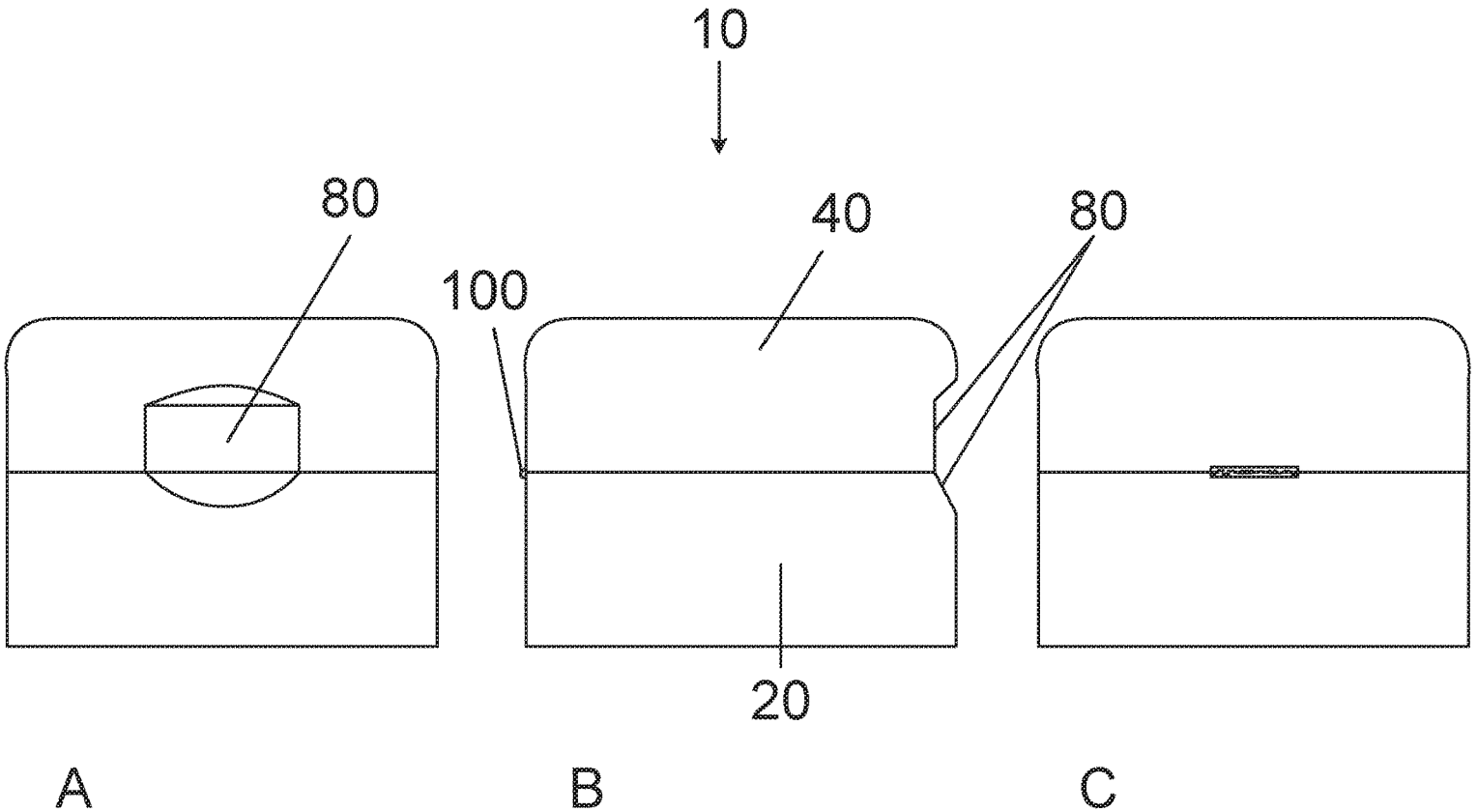
FIG. 9 represents different views of an exemplary apparatus in closed configuration, including a front view showing the flip top opening (A), a side view showing flip top opening (B) and attachment for the cover, and a back view showing the cover attachment.

FIG. 9 shows various perspectives of cap device 10 in a closed position, and as described herein.

Figure 8:
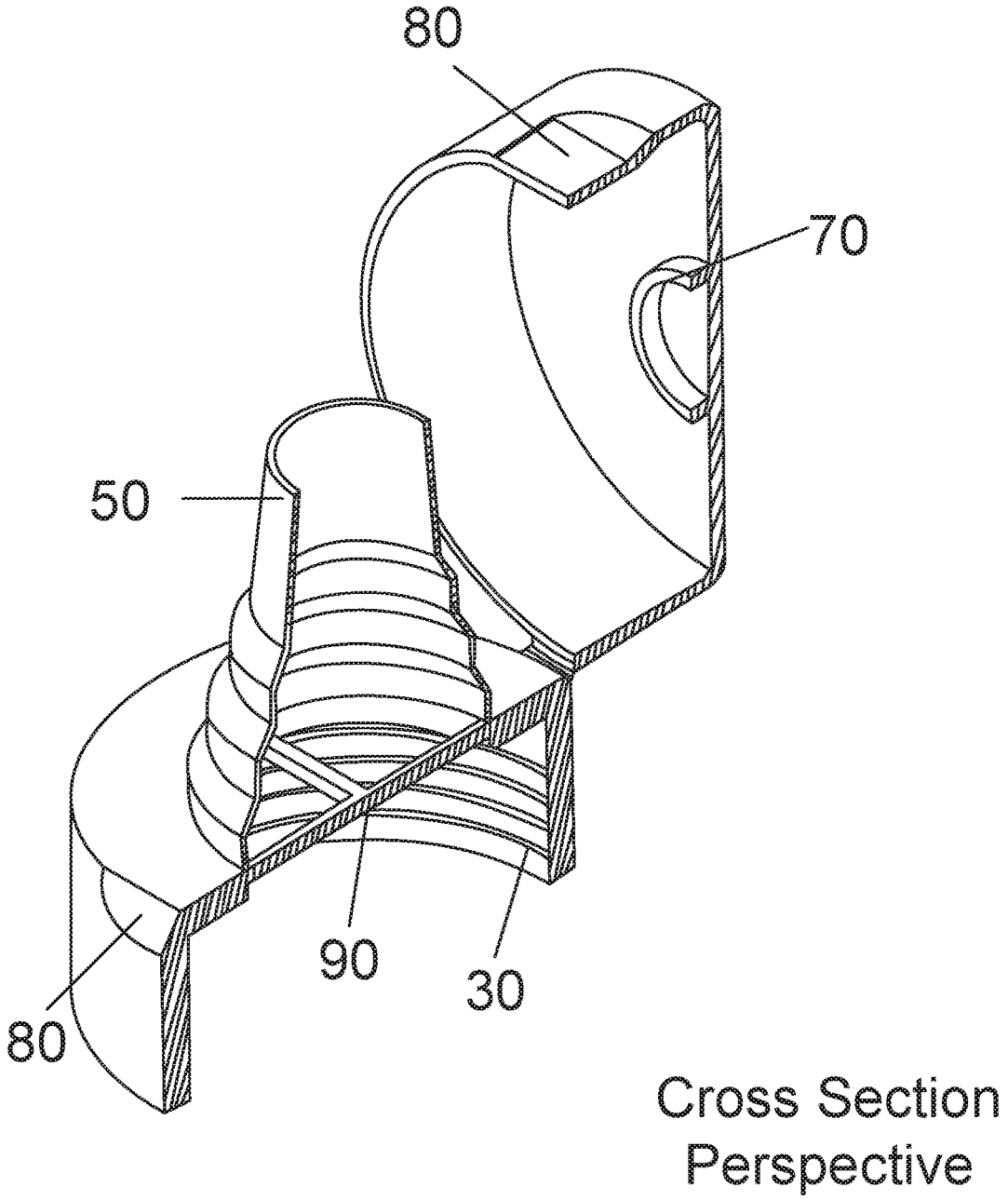
FIG. 8 provides a cross-sectional view of the interior of an exemplary apparatus in open configuration, showing the partial barrier at the base of the spout, a structure on the interior of the cover which can make contact with the bottom of the spout, and threads on the interior of the base.

In one embodiment, shown in FIG. 8, the barrier 90 is located at the top of the spout, and is integrated therewith. In other embodiments, the barrier may be located at the bottom or centrally on the spout 50, and may be configured in numerous shapes and sizes to act as a barrier for large and small materials, and may even be used on multiple locations on the spout 50, e.g., at the top and bottom, see 52, 51.

In some embodiments of the present disclosure, cap device 10 with a spout design is an integrated, one piece, device for use to transfer fluids from a container to another location. In some embodiments, the cap device may be made with any generally available recyclable, inexpensive materials, such as plastics, that can be easily formed/manufactured into the cap device with spout described herein. And, although the device may be completely recycled after just one use, it may be reused as needed, for example when not all of the fluid in the container is initially transferred. Or, it can be repurposed with another container for reuse. The cap device of the present disclosure may come in combination with a container as shown, for example in FIG. 5 or 6, or separately as a standalone device as shown in FIGS. 1A and B. In one embodiment, the cap device is detachably attached to a container using the internal threading 30 of the base 20.

In one embodiment, there is no base cover. Instead the base and spout form the cap when a spout cover is attached to the bottom of the funnel, which could be accomplished by threading, snap on, and the like.

In one aspect, disclosed herein is a cap device with a spout. For example, the cap device can include a cap cover, a cap base and a collapsible spout integrated with the cap base. In some embodiments, the cap base has a continuous side and an interior opening therein. The cap base is connected to the cap cover through interactions between the two. In some embodiments, when the cap device is in a closed configuration, the cap cover interacts with the cap base to prevent fluid flow and forms a cavity between the cap cover and the cap base. The spout is in collapsed form and is entirely received within the cavity. In some embodiments, when the cap device is in an open configuration, the collapsible spout is extended and forms a passage for transferring fluid.

In some embodiments, the cap cover further comprises a first structure motif adapted to form the secure connection with the cap base. In some embodiments, the first structure motif comprises one selected from the group consisting of a living hinge, a cover release, a Snap-On motif, a screw-on motif, and a plug-in motif.

In some embodiments, the cover release is a flip top.

In some embodiments, the cap base further comprises a second structure element for attaching the cap device to an opening of a container. In some embodiments, the second structure motif comprises one selected from the group consisting of a Snap-On motif, a screw-on motif, and a plug-in motif.

In some embodiments, the cap base has threading that starts from the bottom side. In some embodiments, the threading is located on the interior side of the continuous side. In some embodiments, the threading is located on the exterior side of the continuous side.

In some embodiments, the cap cover is permanently attached to the cap base at one side during initial manufacture of the device. In some embodiments, the cap cover and cap base are permanently attached at one side via a living hinge. In some embodiments, the cap base has a top side and a bottom side and the top side comprises an air vent. In some embodiments, the cap base further comprises a partial barrier within the interior opening. In some embodiments, the partial barrier is a cross-hatch form.

In some embodiments, the cap device further comprises a spout expander. In some embodiments, the spout expander is a tab.

In some embodiments, the cap device is a cap for a container. In some embodiments, the container is an oil container. In some embodiments, the cap cover has a dimension that is larger than the interior opening of the cap base.

In one aspect, provided herein is a fluid container that comprises an opening; and a cap device disclosed herein. In some embodiments, the cap device is permanently fused to the container for providing secure closure of the opening. As disclosed herein, the cap device has a collapsible spout and comprises: a cap cover; a cap base and a collapsible spout integrated with the cap base.

In some embodiments, the cap base has a continuous side and an interior opening therein. In some embodiments, the cap base is connected to the cap cover, and the cap cover interacts with the cap base.

In some embodiments, when the cap device is in a closed configuration, the cap cover interacts with the cap base to prevent fluid flow and forms a cavity between the cap cover and the cap base. In some embodiments, the spout is in collapsed form and is entirely received within the cavity.

In some embodiments, when the cap device is in an open configuration, the collapsible spout is extended and forms a passage for transferring fluid.

In some embodiments, the fluid container is an oil container. In some embodiments, the cap base further comprises a top side, and wherein the top side of the cap base further comprises an air vent.

In some embodiments, the cap base further comprises a second structure element for attaching the cap device to an opening of a container. In some embodiments, the second structure motif comprises one selected from the group consisting of a Snap-On motif, a screw-on motif, and a plug-in motif.

In one aspect, disclosed herein is a method for dispensing fluid from a container. The method comprises the steps of using a fluid container comprising a cap device having a collapsible spout; and dispensing fluid from the container when the collapsible spout is in extended form.

In some embodiments, the method further comprises step of extending the collapsible spout prior to dispensing the fluid.

In some embodiments, the step of extending the collapsible spout first requires opening the cap.

In some embodiments, the method further comprises a step of extending the collapsible spout from a fully retracted closed position.

In some embodiments, the cap is added to a container that does not have the cap.

Moreover, while illustrative embodiments have been described herein, the scope thereof includes any and all embodiments having equivalent elements, modifications, omissions, combinations (e.g., of aspects across various embodiments), adaptations and/or alterations as would be appreciated by those in the art based on the present disclosure. For example, the number and orientation of components shown in the exemplary systems may be modified. Further, with respect to the exemplary methods illustrated in the attached drawings, the order and sequence of steps may be modified, and steps may be added or deleted.

Thus, the foregoing description has been presented for purposes of illustration. It is not exhaustive and is not limiting to the precise forms or embodiments disclosed. Modifications and adaptations will be apparent to those skilled in the art from consideration of the specification and practice of the disclosed embodiments.

The claims are to be interpreted broadly based on the language employed in the claims and not limited to examples described in the present specification, which examples are to be construed as non-exclusive. Further, the steps of the disclosed methods may be modified in any manner, including by reordering steps and/or inserting or deleting steps.

What is claimed is:

1. A cap device comprising:

a cap cover;

a cap base having an interior opening, wherein the cap base is connected to the cap cover, the cap base comprising a partial barrier within the interior opening; and a collapsible spout integrated with the cap base, wherein the partial barrier is configured to prevent the extension of the collapsible spout into a container engaged with the cap device, wherein, when the cap device is in a closed configuration, the cap cover interacts with the cap base to prevent fluid flow and forms a cavity between the cap cover and the cap base, and the collapsible spout is in collapsed form and received within the cavity, and wherein, when the cap device is in an open configuration, the cap cover interacts with the cap base to allow fluid flow and the collapsible spout is extended from the cap device and forms a passage for transferring fluid.

2. The cap device of claim 1, wherein the cap cover further comprises a first structure motif adapted to form a secure connection with the cap base.

3. The cap device of claim 2, wherein the first structure motif comprises one selected from the group consisting of a living hinge, a cover release, a Snap-On motif, a screw-on motif, a plug-in motif, and a flip top.

4. The cap device of claim 1, wherein the cap base further comprises a second structure element configured to attach the cap device to an opening of a container.

5. The cap device of claim 4, wherein the second structure element comprises one selected from the group consisting of a Snap-On motif, a screw-on motif, and a plug-in motif.

6. The cap device of claim 1, wherein the partial barrier is a cross-hatch form.

7. The cap device of claim 1, wherein the cap cover has a dimension that is larger than the interior opening of the cap base.

8. A fluid container comprising:

an opening; and a cap device attached to the container, the cap device further comprising:

a cap cover;

a cap base having an interior opening, wherein the cap base is connected to the cap cover; and a collapsible spout integrated with the cap base, wherein the cap base further comprises a partial barrier within the opening that is configured to prevent the extension of the collapsible spout into the opening of the fluid container, wherein, when the cap device is in a closed configuration, the cap cover interacts with the cap base to prevent fluid flow and forms a cavity between the cap cover and the cap base, and the collapsible spout is in collapsed form and received within the cavity, and wherein, when the cap device is in an open configuration, the cap cover interacts with the cap base to allow fluid flow and the collapsible spout is extended from the cap device and forms a passage for transferring fluid.

9. The fluid container of claim 8, wherein the fluid container is an oil container.

10. The fluid container of claim 8, wherein the cap base further comprises a top side.

11. The fluid container of claim 8, wherein the cap base further comprises a second structure element for attaching the cap device to an opening of a container.

12. The fluid container of claim 11, wherein the second structure element comprises one selected from the group consisting of a Snap-On motif, a screw-on motif, and a plug-in motif.

* * * * *